US006421859B1

(12) United States Patent
Hicks et al.

(10) Patent No.: US 6,421,859 B1
(45) **Date of Patent: *Jul. 23, 2002**

(54) PATIENT SUPPORT SYSTEMS WITH LAYERED FLUID SUPPORT MEDIUMS

(75) Inventors: Ronald B. Hicks; John H. Vrzalik, both of San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/712,665

(22) Filed: Nov. 13, 2000

Related U.S. Application Data

(63) Continuation of application No. 09/325,532, filed on Jun. 3, 1999, now Pat. No. 6,145,143.

(51) Int. Cl.[7] ..... A61G 7/057
(52) U.S. Cl. ..... 5/722; 5/723; 5/727; 5/737
(58) Field of Search ..... 5/676, 685, 691, 5/709, 710, 722, 723, 727, 730, 737, 738, 914, 909, 926, 702

(56) References Cited

U.S. PATENT DOCUMENTS 4,599,755 A 7/1986 Tominaga
5,044,029 A 9/1991 Vrzalik
5,101,527 A * 4/1992 Wadsworth, III et al. ..... 5/738
5,189,747 A 3/1993 Mundy et al.
5,201,780 A * 4/1993 Dinsmoor, III et al. ..... 5/926
5,511,260 A 4/1996 Dinsmoor, III
5,636,395 A * 6/1997 Serda ..... 5/909
5,680,662 A * 10/1997 Purdy et al. ..... 5/909
5,701,621 A * 12/1997 Landi et al. ..... 5/691
5,737,788 A * 4/1998 Castellino et al. ..... 5/909
6,145,143 A * 11/2000 Hicks et al. ..... 5/722

* cited by examiner

*Primary Examiner*—Michael F. Trettel

(57) ABSTRACT

A patient support system having multiple patient support layers for reducing and preventing the development of bed sores in bedridden patients. A top patient support surface is provided by an anti-shear cover layer. The anti-shear cover layer being operable to reduce lateral shear forces experienced by a patient moving across the patient support surface. One or more fluid pouches or bladders are provided to form a fluid bladder layer for reducing normal pressures and forces experienced by the patient The fluid bladder layer being releasably or integrally secured to the top surface of an inflatable air mattress. Means are provided operable to secure the anti-shear cover layer and fluid bladder layer in overlapping relation to the inflatable air mattress. Also provided is a means for adjusting the temperature of the fluid contained within the fluid bladder layer.

28 Claims, 9 Drawing Sheets

PATIENT SUPPORT SYSTEMS WITH LAYERED FLUID SUPPORT MEDIUMS

RELATED APPLICATION INFORMATION

This application is a continuation of our co-pending application Ser. No. 09/325,532 entitled PATIENT SUPPORT SYSTEMS WITH LAYERED FLUID SUPPORT MEDIUMS filed Jun. 3, 1999 now Pat. No. 6,145,143.

BACKGROUND OF THE INVENTION

1. Field of the Invention

This invention relates generally to a patient support system for reducing and preventing the development of decubitus ulcers or bed sores in patients. More specifically, the present invention relates to a patient support system comprising multiple support layers whereby each layer is operable to reduce the lateral and normal pressures and forces which can cause such bed sores on a patient. In particular, the present invention relates to a low-air-loss patient support system including an anti-shear cover layer overlapping a fluid bladder or pouch layer which is positioned in overlying relation or integral to the upper surface of a low-air-loss bed.

2. Background

A major concern for health care providers is the prevention of the development of bed sores in bedridden patients. Such bed sores are a frequent medical complication in patients suffering from trauma that can lead to the deterioration of the patient's skin and underlying tissue. For example, bum victims are extremely susceptible to both the development of bed sores and continued exasperation of existing wounds. Bed sores are also frequently found to occur at the bony protuberances along a patient's body. More specifically, when a patient lies supinely against a support surface, most of the patient's weight is supported by the bony protuberances located along such areas as the hip, the scapula, the spinal area, heels and occipital region of the head. As a result, the normal pressures and forces exerted upon these areas by the patient's weight compresses the capillaries present within the soft tissue surrounding the patient's skeletal protuberances. This compressive forces causes a reduction in blood circulation to that soft tissue, which may lead to the development of a bed sore.

Other factors which can lead to the development of bed sores include the following: the lateral shearing forces experienced by the patient's skin as he or she moves or is moved across the support surface, the normal forces and pressures experienced by a patient's body resting atop a support surface, an accumulation of moisture between the patient's skin and the patient support surface, and various other medical and traumatic conditions which enhance the breakdown or degradation of a patient's skin.

Due to the numerous and complex factors leading to the development of bed sores, current product designs have been limited to addressing only particular factors or subsets of factors associated with bed sore development. For instance, in its attempt to solve the problem of bed sores in bedridden patients, U.S. Pat. No. 5,511,260 discloses a mattress pad comprising a film layer positioned atop a fluid bladder layer supported by foam base layer. Though this particular mattress pad may effectively address the normal forces and pressures experienced by a patient's body resting atop its support surface, it fails to adequately address the problem of moisture accumulation between the patient and the patient support surface. As discussed above, moisture accumulation is a major factor in the development of bed sores. Likewise, U.S. Pat No. 5,044,029 discloses a low-air-oss bed capable of uniformly distributing the supporting pressure points along the body surface, thereby reducing the normal pressures and forces experienced at the critical bony protuberances. This patient support alone, however, does not adequately address the lateral shear forces experienced by the patient as he or she is moved across the support surface. As illustrated, no single prior art provides protection against the wide range of bed sore causing factors. With this in mind, the present invention was developed.

As disclosed, the present invention represents an improved patient support system over the prior art for the prevention of bed sores in patients. As will be appreciated by those skilled in the art, this invention is specially designed to either reduce or prevent a greater number of bed sore causing factors than previously addressed by the prior art. In particular, the present invention provides numerous advantages to bedridden patients heretofore found only associated with separate and distinctly different patient support systems. These advantages include its ability to adjust the positioning and immobilization of the patient as desired by adjusting the air pressure within individual chambers or zones of chambers, its ability to dramatically reduce undesirable lateral shearing forces between the patient and the support surface, its ability to wick moisture away from the patient's body, and its ability to further reduce normal pressures and forces at specific locations along the patient's body.

It is, therefore, an object of the present invention to provide a patient support system comprising an inflatable patient support, a fluid bladder or pouch layer positioned in overlying relation to the upper surface of the inflatable patient support, means for securing the fluid bladder layer to the upper surface of the inflatable patient support, an anti-shear cover layer placed in overlying relation to the upper surface of the fluid bladder layer and inflatable patient support, means for securing the anti-shear cover layer to the fluid bladder layer and/or inflatable patient support, and means for facilitating substantial sliding movement between the top and bottom layers of the anti-shear cover layer thereby reducing the lateral shear forces experienced by a patient supported thereon.

It is a further object of the present invention to provide a fluid bladder layer that can be conveniently secured to an existing inflatable patient support.

Another object of the present invention is to provide a fluid bladder layer in which the fluid bladders or pouches are secured atop an inflatable patient support in configuration that is customized to the pressure points along a particular patient's body.

Another object of the present invention is to provide a fluid bladder layer assembled with releasable discrete fluid bladders or pouches so as to allow such bladders or pouches to be removed or replaced as may be required.

Another object of the present invention is to provide an inflatable patient support having attachment means for securing at least one fluid bladder or pouch to the upper surface of the inflatable patient support to form a fluid bladder layer.

Another object of the present invention is to provide a patient support system comprising an anti-shear cover layer, a fluid bladder layer, and an inflatable patient support where at least a portion of each is specially designed and fabricated with a gas permeable surface material to enable moisture on the patient's body to be directed into the air chambers of the inflatable patient support where it is removed by the circulation of fresh inflation air.

Another object of the present invention is to provide an inflatable patient support having at least a portion of which is made of a moisture vapor permeable material.

Another object of the present invention is to provide an anti-shear cover layer comprised of a top layer bounded to a bottom layer to form an internal chamber for containing a lubricant that enhances the relative sliding movement between the adjacent contacting surfaces of the top layer and bottom layer and, thus, allows a patient resting atop the top layer to slide relative to the bottom layer thereby reducing the frictional force normally experienced by a patient moving across a patient support surface.

Another object of the present invention is to provide an anti-shear cover layer that can be quickly and easily removed to allow for convenient maintenance to the underlying fluid bladder layer or inflatable patient support as may be required.

Another object of the present invention is to provide a means for regulating the temperature of the fluid contained within the fluid bladder layer and, thereby, allow the operator or patient to effectively maintain a desired patient body surface temperature.

Other objects and advantages will be apparent to those of ordinary skill in the art from the following disclosure.

SUMMARY OF THE INVENTION

These objects and advantages are accomplished in the present invention by providing a patient support system comprising an anti-shear cover layer for overlapping a fluid bladder layer positioned atop an inflatable patient support. The anti-shear cover layer is comprised of a top fabric layer forming a patient support surface and a bottom fabric layer positioned substantially adjacent to the top surface of a fluid bladder support layer. The peripheral edge of the top fabric layer is secured to the peripheral edge of the underlying bottom fabric layer which forms a chamber between the top and bottom layers, into which a lubricant material is disposed to enhance slippage between the contacting surfaces of the two layers. The bottom surface of the bottom layer is secured to the fluid bladder layer by connecting means and/or frictional forces and is, therefore, generally held in a fixed position. The top fabric layer, however, is only secured about its peripheral edge to the bottom fabric layer and is, therefore, able to slide relative to the bottom fabric layer. In this manner, a patient resting atop the anti-shear cover layer experiences reduced frictional and lateral shear forces as the top patient support layer, through the action of the lubricant material, is able to slide relative to the bottom layer which is relatively affixed to the top surface of either the fluid bladder layer or inflatable air mattress. Under certain circumstances and with particular patient supports, it may be desirable to provide means which prevent any excessive slippage of a patient supported on an anti-shear cover layer. For example, the middle section of the top fabric layer, corresponding to the torso section of the patient, can be attached to the bottom fabric layer. In this way, movement of the patient's torso section is limited; however, the patient's upper and lower body are able to slide relative to the underlying bottom layer of the anti-shear cover layer. At least a portion of the anti-shear cover layer is constructed of a water vapor permeable material to help eliminate moisture from between the patient's body and the contacting surface of the top layer.

Also provided is a fluid bladder layer comprising a plurality of discrete fluid bladders or pouches for reducing the normal pressures and forces experienced by a patient resting atop the patient support surface. The fluid bladder layer is specially designed to be positioned in overlying relation to the upper surface of an inflatable patient support, and is provided with means to releasably secure the fluid bladder layer to the inflatable patient support. The fluid bladder layer includes one or more discrete fluid pouches releasably or integrally secured to a fabric sheet at positions on the fabric sheet which correspond to increased pressure points on the patient's body, such as the heel, buttocks, or scapula. The fluid pouch retaining fabric sheet is draped over the underlying inflatable patient support, thereby arranging the fluid pouches on the upper surface of the inflatable patient support at preferred positions corresponding to areas on the patient's body which may be susceptible to the development of bed sores. Using individually detachable fluid pouches enables the fluid bladder layer to be customized to best suit the characteristics of a particular bed user. Portions of the fabric sheet are constructed of a water vapor permeable material to promote the elimination of moisture from the patient's body.

Also provided is a fluid bladder layer comprising a plurality of discrete fluid pouches operably secured to specific positions atop an inflatable patient support More specifically, the fluid bladder layer is formed by securing one or more discrete fluid pouches directly to the surface of the inflatable patient support at positions which correspond to areas on the patient's body that are susceptible to bed sore development. Alternatively, a fluid bladder layer is provided as an integral component of an inflatable patient support. In this way, the inflatable air chamber or air chambers comprising an inflatable patient support are assembled having fluid pouches integrally secured substantially adjacent to the upper surface of the inflatable patient support.

Also provided is a low-air-loss bed comprising at least one gas permeable air chamber mounted on a base frame, and placed in fluid communication with a source of gas. The air chamber or chambers are in communication with a gas source operable to change the amount of gas delivered to the air chamber or chambers, thereby varying the amount of support provided for each portion of the patient. The air chamber or chambers may be constructed of a first material which is relatively impermeable to gas and a second material which is gas permeable, the sides and bottom of each chamber being preferably constructed of the second material.

Further objects and advantages of the invention will be readily apparent to those skilled in the art from the following description taken in conjunction with the accompanying drawings. The drawings constitute part of this specification and include exemplary embodiments of the present invention and illustrate various objects and features thereof.

DETAILED DESCRIPTION OF THE INVENTION

As required, preferred embodiments of the present invention are described herein; however, the disclosed embodiments are merely exemplary of the invention that may be embodied in various forms. The figures are not necessarily to scale; some features may be exaggerated to show details of particular components. Specific structural and functional details disclosed herein are therefore not to be interpreted as limiting, but provide a basis for the claims and a representative basis for teaching one skilled in the art to variously employ the present invention.

Figure 1:
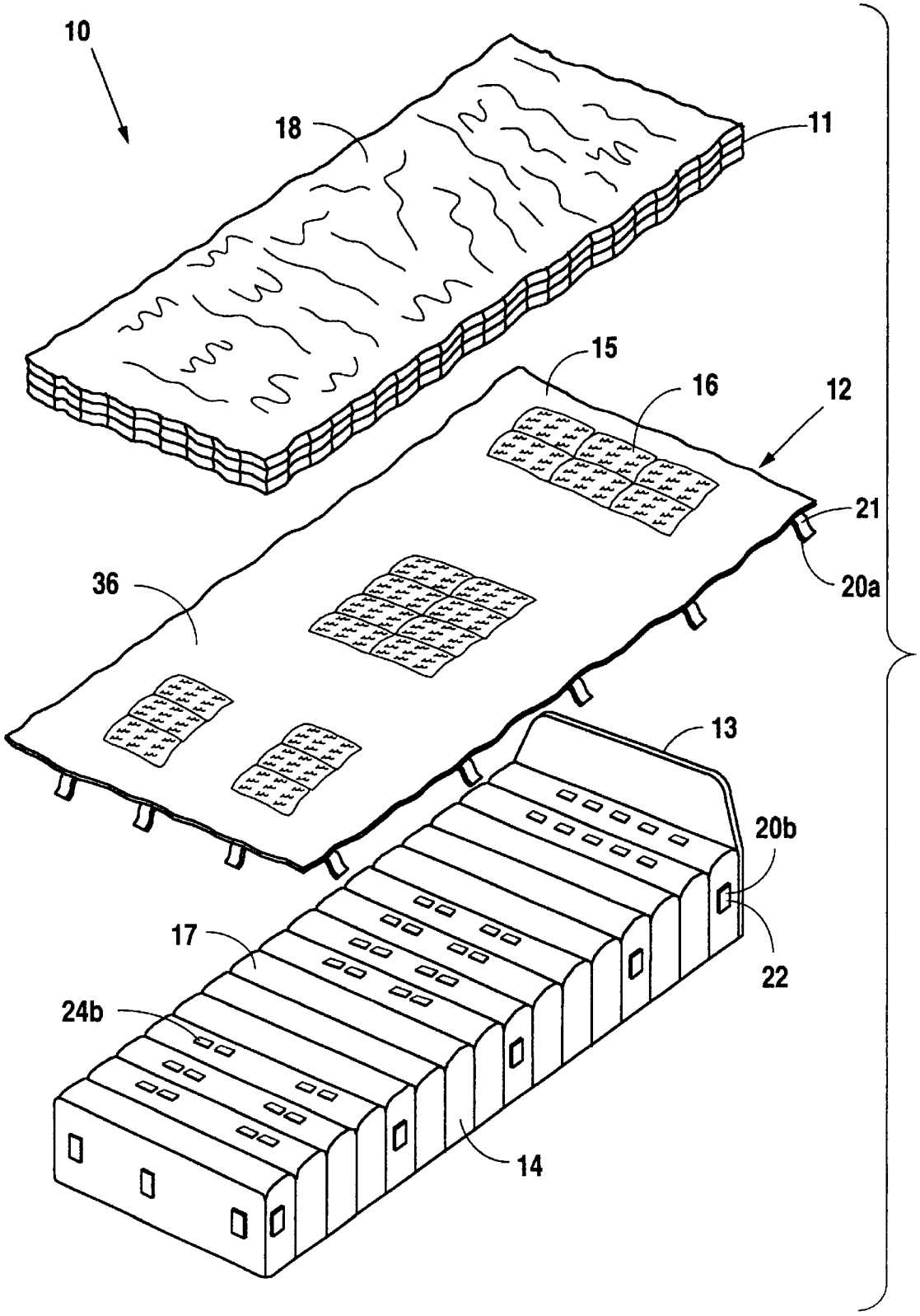
FIG. 1 is an exploded view of the presently preferred embodiment of the fluid air patient support system of the present invention.

Referring to the accompanying drawings, FIGS. 1 through 12, at least one embodiment of the present invention may be appreciated to prevent the development of bed sores in a patient confined to a bed for an indefinite period of time. With reference to FIG. 1, there is shown a patient support system 10 comprising multiple patient support layers including an anti-shear cover layer 11 overlaying a fluid bladder layer 12 positioned in overlying relation to an inflatable air mattress 13, or other inflatable patient support. In a preferred embodiment, the anti-shear cover layer 11 and fluid bladder layer 12 are releasably secured atop the inflatable air mattress 13 to facilitate convenient removal for cleaning, adjustment or other required maintenance.

As illustrated in FIG. 1, the inflatable air mattress 13 of the present invention is preferably a plurality of joined inflatable air cushions 14 to allow for better pressure control in each of the air cushions 14 so that the inflatable cushions 14 can be collectively adjusted to better accommodate patients of varying heights and weight. In this way, the pressure within each inflatable air cushion 14 can be adjusted so as to allow the patient to sink into the inflatable mattress 13 without bottoming out on the mattress support surface (not shown). As the patient sinks into the inflatable mattress 13, the normal pressure and force imposed against particular pressure points on the patient's skin is distributed over a greater skin surface area. Each inflatable air cushion 14 is preferably constructed of a fabric material which is permeable to water vapor, but impermeable to water and other liquids. One such suitable fabric material is the fabric sold under the trademark "GORE-TEX." An inflatable air mattress system that is suitable for adaptation with the present invention is presently commercialized under the trademark "THERAKAIR", commercially available from Kinetics Concepts, Inc., of San Antonio, Tex. ("KCI"). The THERAKAIR bed is described in substantial detail in U.S. Pat. No. 5,267,364, and incorporated herein by this reference. It should be understood by those skilled in the art, however, that alternative inflatable air mattress systems, configurations, and construction can be utilized without departing from the scope of the present invention.

As shown in FIG. 1, the fluid bladder: layer 12 is positioned so as to overlap the full length of the underlying inflatable air mattress 13. More particularly, a preferred fluid bladder layer 12 comprises one or more fluid pouches 16 integrally or releasably secured to a full length fabric sheet 15 which is placed in overlying relation to the entire length of the inflatable air mattress 13. Providing fluid pouches 16 which are releasably secured to the surface of the fabric sheet 15 enables a bed user to customize a fluid bladder layer 12 to the needs of a particular patient. The fluid pouches 16 can be assembled on the fabric sheet 15 so as to form an essentially continuous layer of fluid pouches 16 overlying the inflatable air mattress 13, or overlay only a portion of the inflatable air mattress 13. More specifically, a particular fluid pouch 16 can be aligned and secured to the surface of the fabric sheet 15 at a specific position so that when the fabric sheet 15 is placed over the inflatable air mattress 13 that fluid pouch 16 is positioned at a patient's most susceptible area or areas of bed sore development. These areas may correspond with trauma sites or the pressure points associated with the bony protuberances of a patient such as the heels, the buttocks, the scapula, and the occipital region of the head. As further illustrated in FIG. 1, the anti-shear cover layer 11 forms a patient support surface 18 and is, as will be explained in more detail below, specially designed to reduce any undesirable lateral shear forces experienced by the patient as he or she moves or is moved laterally across the patient support surface 18.

Figure 2:
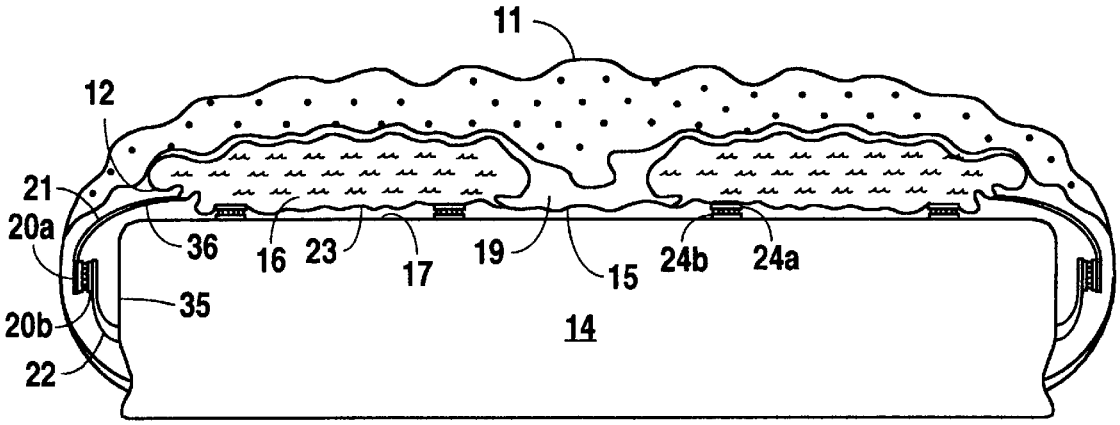
FIG. 2 is a vertical sectional view taken through the anti-shear cover layer and fluid bladder layer secured to an underlying inflatable air cushion.
Figure 3:
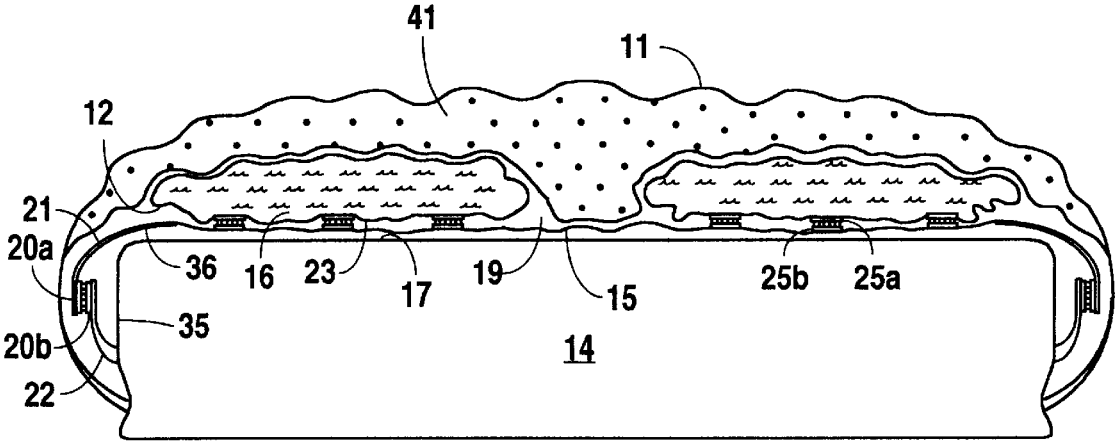
FIG. 3 is a vertical sectional view similar to FIG. 2, except the fluid pouches are shown releasably secured to the upper surface of the fabric sheet component of the fluid bladder layer.

As shown in FIGS. 1, 2 and 3, a preferred fluid bladder layer 12 comprises one or more fluid pouches 16 integrally attached (as shown in FIG. 2) or releasably secured to a fabric sheet 15 (as shown in FIG. 3). Alternatively, the fluid bladder layer 12 can be formed by integrally attaching one or more fluid pouches 16 to the upper surface 17 of an inflatable air cushion 14 (FIG. 8), as will be discussed in more detail below. With reference to FIGS. 2 and 3, the fluid bladder layer 12 is shown overlapped by the anti-shear cover layer 11, and positioned in overlying relation to the upper surface 17 of an inflatable air cushion 14. In a preferred embodiment, at least a portion of the fabric sheet 15 is constructed of a low-air-loss fabric material which is permeable to water vapor, but impermeable to water and other liquids. One such suitable fabric material is the fabric sold under the trademark "GORE-TEX" from W.L. Gore & Associates, Inc. of Elkton, Md. Such low-air-loss material has very little air permeability yet has a moisture vapor transmission rate in excess of 4700 $g/m^2/24$ hours. This preferred material allows any moisture that may accumulate to be drawn through the vapor permeable fabric sheet 15 and away from the patient.

Referring to FIGS. 1, 2 and 3, the fabric sheet 15 is constructed having an area bordered by a peripheral edge 36 which is oversized relative to the upper surface 17 of the inflatable air mattress 13. This preferred oversizing allows the peripheral edge 36 of the fabric sheet 15 to extend downward and adjacent to the side wall 35 of the inflatable air mattress 13. Oversizing the fabric sheet 15 provides a fluid bladder layer 12 with a relatively loose and bunched configuration atop the upper surface 17 of the air mattress 13. As will be understood by those skilled in the art, oversizing the fabric sheet 15 is necessary to prevent the fluid bladder layer 12 and/or fabric sheet 15 from pulling taut when a patient is placed onto the patient support system 10 and, thus, allows the patient to sink into the inflatable air mattress 13. Oversizing the fabric sheet 15 further prevents the exertion of pulling forces upon the attachments connecting the fabric sheet 15 to the side wall 35 of the inflatable air mattress 13, which could potentially cause damage to the inflatable air mattress 13, resulting in an air leak.

As shown in FIGS. 1, 2 and 3, a preferred fluid bladder layer 12 is held atop the inflatable air mattress 13 using a connecting means 20*a* which is attached to a plurality of fabric strips 21 secured to and extending perpendicular from the perimeter 36 of the fabric sheet 15. In use, each connector 20*a* is attached to a corresponding connector 20*b* which is secured to a fabric strip 22 that is engaged to the side wall 35 of the inflatable air mattress 13 or, alternatively, the corresponding connector 20*b* is secured directly to the side wall 35. Connectors 20*a–b* can include a zipper mechanism, hook and loop connectors, a buckle mechanism, snaps, clips, or some similar connecting mechanism. Providing a fluid bladder layer 12 with quick release connectors 20*a–b* enables a bed user to quickly and easily remove the fluid bladder layer 12 as may be necessary for the purpose of routine cleaning and maintenance; or altered patient treatment.

In another embodiment, the fluid bladder layer 12 can be secured to the inflatable mattress by incorporating an elastic band or similar material into the peripheral edge of the fabric sheet 15 (not shown). In this embodiment, the fluid bladder layer 12 is placed atop the inflatable air mattress 13, and the elastic band draws the fabric sheet 15 tight about the side wall 35 of the inflatable air mattress 13 as the elastic peripheral edge is positioned in overlying relation to the side wall 35 of the inflatable air mattress 13. In a further embodiment, a fluid bladder layer 12 can be secured atop the inflatable air mattress 13 by securing the peripheral edge 36 of the fluid bladder layer 12 to the mattress support frame using buckles, snap fasteners, hook and loop connectors, or some similar attachment mechanism.

In another embodiment, as shown in FIGS. 1 and 2, the upper surface 17 of the inflatable air mattress 13 and the bottom surface 23 of the fluid pouch 16 is constructed or fitted with means for securing the fluid pouch or pouches 16 directly against the upper surface 17. This embodiment provides increased attachment between the bottom surface 23 of the fluid pouch 16 and the adjacent upper surface 17 of the inflatable air mattress 13 and, thereby, reinforces and maintains the desired therapeutic placement of the fluid pouches 16 on the upper surface 17. In a preferred embodiment, the means for securing the fluid pouch 16 is a hook and loop adhesive tape 24*a–b* such as that commonly sold under the trademark VELCRO. The adhesive tape 24*a* is either glued or welded to the bottom surface 23 of the fluid pouch 16 and engages with corresponding hook and loop tape 24*b* affixed to the upper surface 17 of the air mattress 13. Positioning a fluid bladder layer 12 in overlying relation to an inflatable air mattress 13 aligns the hook and loop tape 24*a–b* secured to the bottom surface 23 of the fluid pouch 16 with the corresponding adhesive tape 24*b* secured to the upper surface 17 of an inflatable air cushion 14. Once the fluid bladder layer 12 is positioned, both the hook and loop tape 24*a–b* together with the connectors 20*a–b* prevent the shifting and sliding of any particular fluid pouch 16 from its desired position atop the inflatable air mattress 13 as the patient moves or is moved across the patient support surface 18.

With reference to FIG. 3, a fluid bladder layer 12 is provided by securing one or more discrete fluid pouches 16 to the upper surface 19 of a fabric sheet 15 which is placed atop the upper surface 17 of an inflatable air mattress 13 or other inflatable patient support. In a preferred embodiment, a bed user is able to provide a customized fluid bladder layer 12 by releasably attaching one or more fluid pouches 16 to the upper surface 19, thereby forming a fluid bladder layer 12 specific to a particular patient's needs. The fluid bladder layer 12 is then positioned over the upper surface 17 of the inflatable air mattress 13, and secured to the air mattress and/or mattress support frame as described above. In this alternative embodiment, the fabric sheet 15 is constructed with attachment means 25*a–b* for securing a plurality of fluid pouches 16 to the upper surface 19 of the fabric sheet 15. Such attachment means are secured to the upper surface 19 and is preferably a hook and loop adhesive material such as VELCRO. Each fluid pouch 16 is further constructed with a portion of its bottom surface 23 being VELCRO or other similar adhesive material which attaches to the VELCRO secured to the upper surface 19 of the fabric sheet 15. It is preferred that the VELCRO be glued to the outer surface of the fluid pouch to prevent damage to and rupture of the pouch. It is also preferred that VELCRO strips be secured along the full length of the fabric sheets 15 upper surface 19 to accommodate the attachment of a plurality of fluid pouches 16, thereby providing selective and increased pressure reduction at regions along a patient's body that may be susceptible to bed sore development In this way, patients of varying heights and medical conditions can be provided with substantial therapeutic relief by selectively securing to the fabric sheet 15 one or more fluid pouches 16 corresponding to that patient's particular body or medical characteristics. This embodiment therefore allows a patient and/or bed user to selectively readjust the pressure compensating fluid bladder layer 12 as may be required and is, therefore, extremely cost effective and patient specific. The user of the present invention can therefore easily and quickly overlay a tailored fluid bladder layer 12 atop an inflatable air mattress 13, and thereby position therapeutically beneficial fluid pouches 16 at potential or actual problematic areas along the patient's body. It should be understood by someone skilled in the art that alternative means for attaching the fluid pouches to the fabric sheet overlay can be accomplished without deviating from the scope of the present invention. By way of example, such means may include snaps or placing the fluid pouches 16 into pouches mounted to the fabric sheet 15 which are then closed to secure the fluid pouches 16. Furthermore, it should be understood that the fluid pouches 16 can be placed along either the upper or bottom surface of the fabric sheet 15, or both, without deviating from the scope of the present invention.

The present invention further comprises a means for regulating the temperature contained within each fluid pouch 16, as an aid in maintaining patient comfort (not shown). In a preferred embodiment, the fluid pouches 16 comprising the fluid bladder layer 12 are positioned substantially adjacent to a temperature coil to heat or cool the fluid contained within the fluid pouch 16 as may be desired. Through selective heating or cooling of one or more of the fluid pouches 16, each fluid pouch 16 not only provides a means for reducing the normal pressure and force exerted upon the patient's body, but also provides an effective heat pack or cold pack. The temperature coil is preferably positioned between the fluid bladder layer 12 and the inflatable air mattress 13, and is constructed of flexible fluid containing coils placed in communication with a means for heating and cooling the fluid contained within the coil. The coils are positioned substantially adjacent to the fluid bladder layer 12 so as to facilitate a substantial transfer of heat to the fluid pouch 16, or the removal of heat away from the fluid pouch 16 where cooling is desired. As will be understood by those skilled in the art, various other means for heating or cooling the fluid within the fluid pouch 16 can be undertaken without deviating from the scope of the present invention. One such means may include circuiting chilled or heated liquids through tubes immersed in the fluid. It should be further understood that this embodiment provides a means for regulating the body temperature of the patient together with the combined therapeutic benefits of an inflatable air mattress 13 and pressure compensating fluid bladder layer 12.

In its preferred embodiment, the fluid contained within the fluid pouch 16 is a viscous, flowable, pressure-compensating composition which flows only gradually when subjected to continuously applied pressure, but has the ability to retain its shape and position in the absence of pressure. Suitable pressure-compensating compositions are set forth and identified in U.S. Pat No. 5,362,543. In addition to the described pressure compensating properties, the preferred fluid is a liquid with a viscosity greater than the viscosity of water. It should be understood by those skilled in the art, however, that a wide range of fluids such as water, oil, water-based or petroleum-based compounds can be utilized without departing from the scope of invention.

Figure 4A:
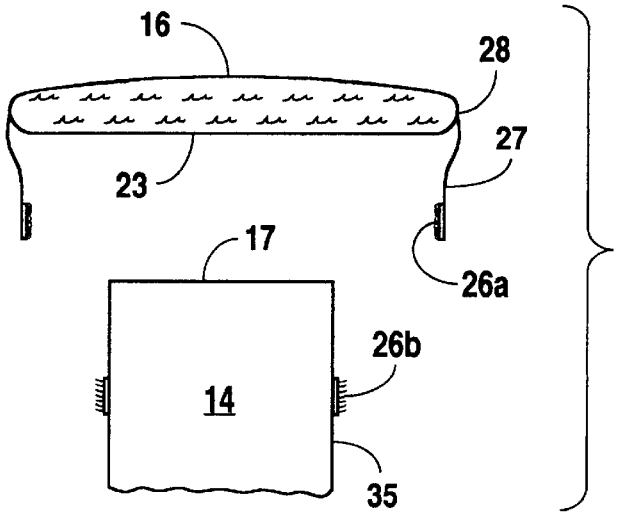
FIG. 4 shows an alternate embodiment for attaching discrete fluid pouches to an underlying inflatable air cushion for forming a fluid bladder layer.
Figure 4B:
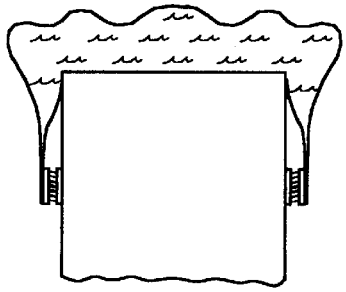
Figure 4C:
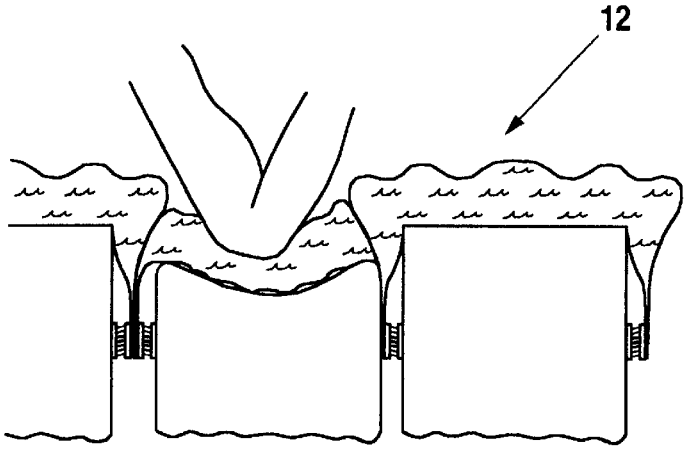
Figure 5:
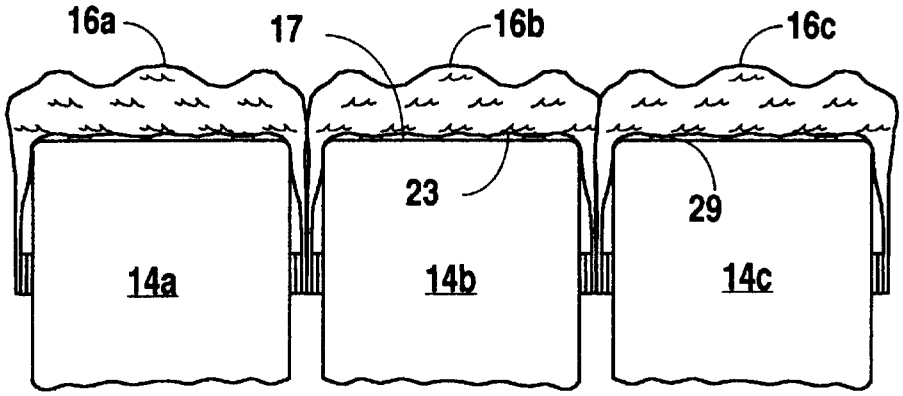
FIG. 5 is a cross-sectional view showing another alternate embodiment for releasably securing fluid pouches to underlying inflatable air cushions which form an inflatable air mattress.
Figure 6A:
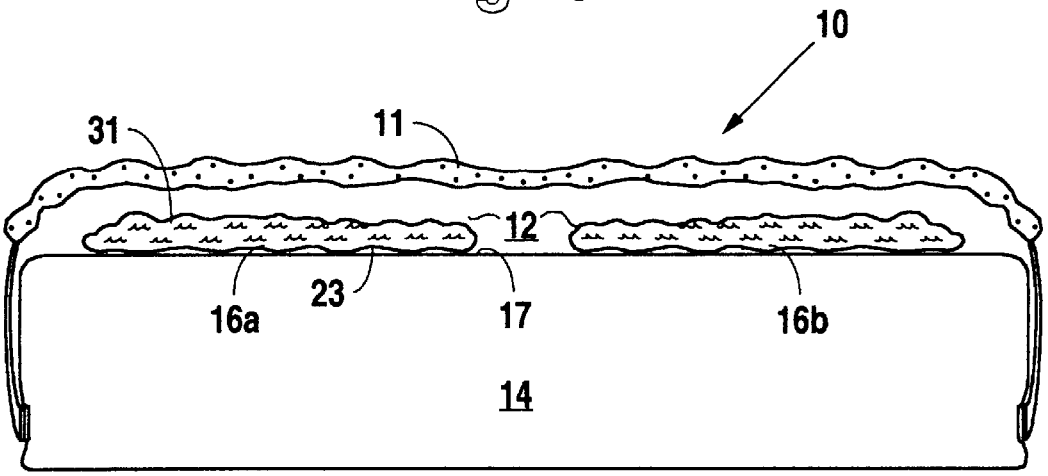
FIG. 6 is a vertical sectional view taken through the anti-shear cover layer overlaying the alternate fluid bladder layer shown in FIG. 5, and illustrating the operation of the fluid bladder layer and inflatable air cushion to support a patient's bony protuberance (i.e. heel).
Figure 6B:
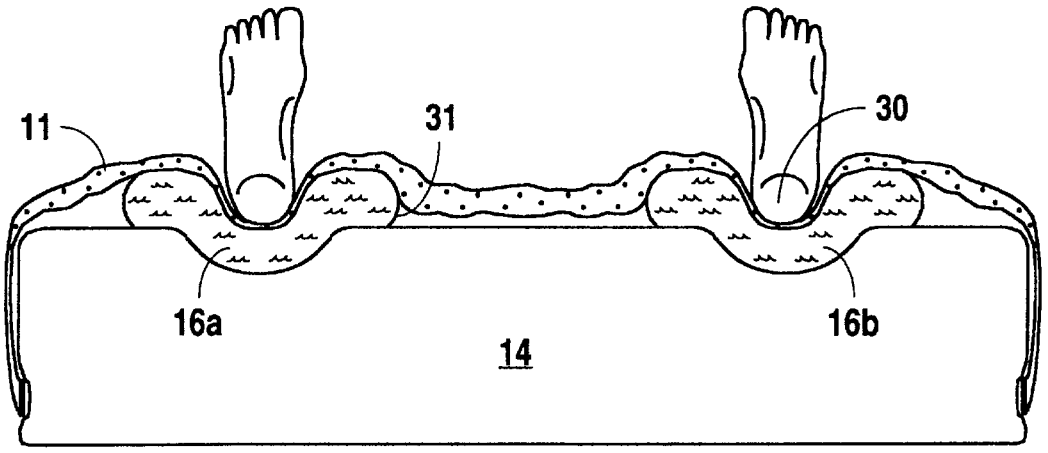

Alternative embodiments of a fluid bladder layer 12 are shown in FIGS. 4, 5 and 6, and as illustrated do not incorporate the use of a fabric sheet 15. As shown in FIG. 4, and described in more detail below, a fluid bladder layer 12 is formed by releasably attaching one or more pressure compensating fluid pouches 16 substantially adjacent to the upper surface 17 of an inflatable air cushion 14. As will be understood by those skilled in the art, this embodiment provides a bed user with the ability to quickly and easily adjust the positioning of fluid pouches 16 atop the upper surface 17 and is, therefore, extremely advantageous by providing a patient with ready access to an individualized pressure compensating fluid bladder layer 12 together with the attributes of an inflatable patient support 13.

As is illustrated in FIG. 4, an alternative embodiment for a fluid bladder layer 12 is provided which does not incorporate a fabric sheet overlay 15, but includes one or more fluid pouches 16 constructed with connector means so as to provide a bed user with the ability to quickly and easily secure or remove the fluid pouch 16 from the upper surface 17 of the inflatable air mattress 13.

As shown, an alternative fluid bladder layer 12 is provided by using VELCRO connectors 26*a–b* to secure the bottom surface 23 of one or more fluid pouches 16 substantially adjacent to the upper surface 17 of at least one inflatable air cushion 14. In this embodiment, VELCRO connectors 26*a* are attached to multiple fabric strips 27 that are fixed about the peripheral edge 28 of a fluid pouch 16 As shown, a fabric strip 27 of the present embodiment has a first end secured to the peripheral edge 28 of a fluid pouch 16, and a second end which is positioned perpendicular to the peripheral edge 24. One or more VELCRO connectors 26*a* are attached to the second end and connect with corresponding VELCRO adhesive connectors 26*b* secured to the side wall 35 of an inflatable air cushion 14. The first end of the fabric strip 27 is preferably glued, heat sealed, or welded to the peripheral surface of the fluid pouch 16. The fabric strip 27 is preferably made of an elastic fabric material which draws tight once the fabric strip 27 is secured to air cushion 14. In use, the fluid pouch 16 is positioned atop the upper surface 17 of the inflatable air cushion 14, and the fabric strip 23 is pulled downwardly along the surface of the side wall 35 so as to attach the VELCRO connector 26*a* to its corresponding connector 26*b*. This embodiment enables a bed user to conveniently attach one or more fluid pouches 16 as may be needed, or quickly remove a fluid pouch should one develop a leak, require cleaning or other maintenance. It should be understood by someone skilled in the art, however, that various other options for positioning the bottom surface 23 of one or more fluid pouches 16 substantially adjacent to the upper surface 17 of the inflatable air mattress 13 can be used without deviating from the scope of the present invention.

In another alternative embodiment, as disclosed in FIG. 5, a fluid bladder layer 12 is provided by positioning the bottom surface 23 of one or more fluid pouches 16*a–c* substantially adjacent to the upper surface 17 of an inflatable air cushion 14 using means for attachment secured to the bottom surface 23 of the fluid pouch 16*a–c*. The attachment means 29 fastens to corresponding attachment means integrally attached, glued, welded, or stitched to the upper surface 17 of the inflatable air cushion 14. Such attachment means 29 include hook and loop adhesive material, snaps or other similar attachment means. In a further alternate embodiment, it the fluid pouches 16 are constructed with both VELCRO connectors 26*a–b* (FIG. 3), and attachment means 29 (FIG. 4) to provide a fluid bladder layer 12 with ease of removal and stability atop an inflatable air cushion 14. In this way, a fluid pouch 16 is secured atop an inflatable air cushion 14 in such a manner that as a patient is moved or moves across the patient support surface the fluid pouch 16 remains positioned atop the desired inflatable air cushion 14, and does not slide down between adjacent inflatable air cushions 14*a–c*.

FIG. 6 illustrates an embodiment of the fluid air patient support system 10 supporting the protruding bony area of a patient's heel 30. As shown, an anti-shear cover layer 11 is placed in overlying relation to the upper surface 31 of fluid pouches 16*a–b* which form a fluid bladder layer 12 that provides pressure reduction to the heel 30 of a patient Each discrete fluid pouch 16*a–h* is independently secured to the air cushion 14 using means discussed above, so that where only one heel may require increased pressure reduction, a single fluid pouch 16*a* can be utilized, while the opposing pouch 16*b* is simply removed. In use, a patient's heel 30 sinks into the upper surface 31 of a fluid pouch 16, and the bottom surface 23 of the fluid pouch 16 depresses into the inflatable air cushion 14. The viscous fluid contained within the fluid pouch 16 flows upwardly along the patient's skin and the normal pressure and forces imposed against the bony protruding heel 30 are thereby distributed over a greater surface area surrounding the heel 30.

Figure 7:
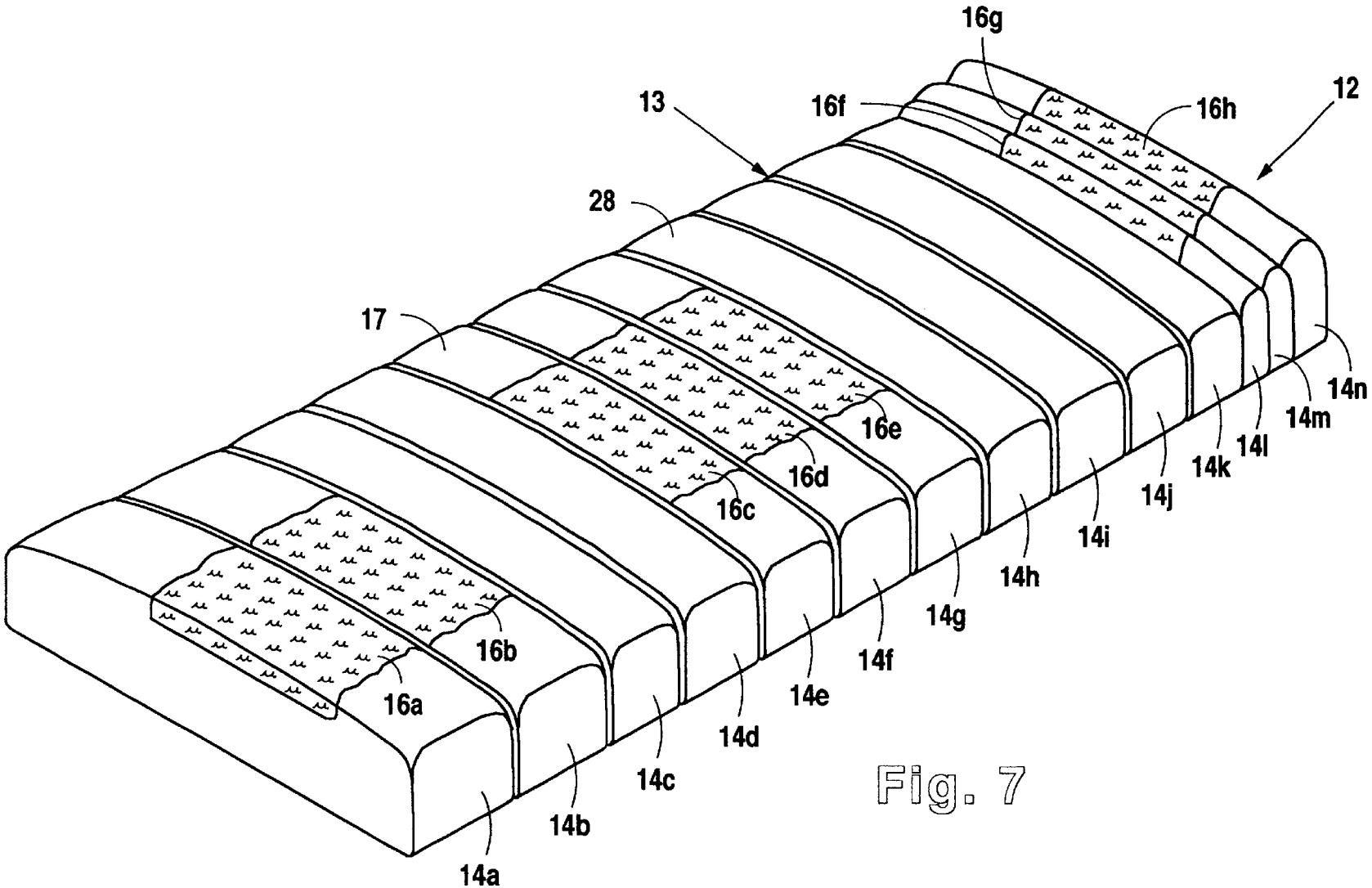
FIG. 7 is a perspective view showing an alternate embodiment for a fluid bladder layer constructed integral to the underlying inflatable air cushions which form an inflatable air mattress.
Figure 8A:
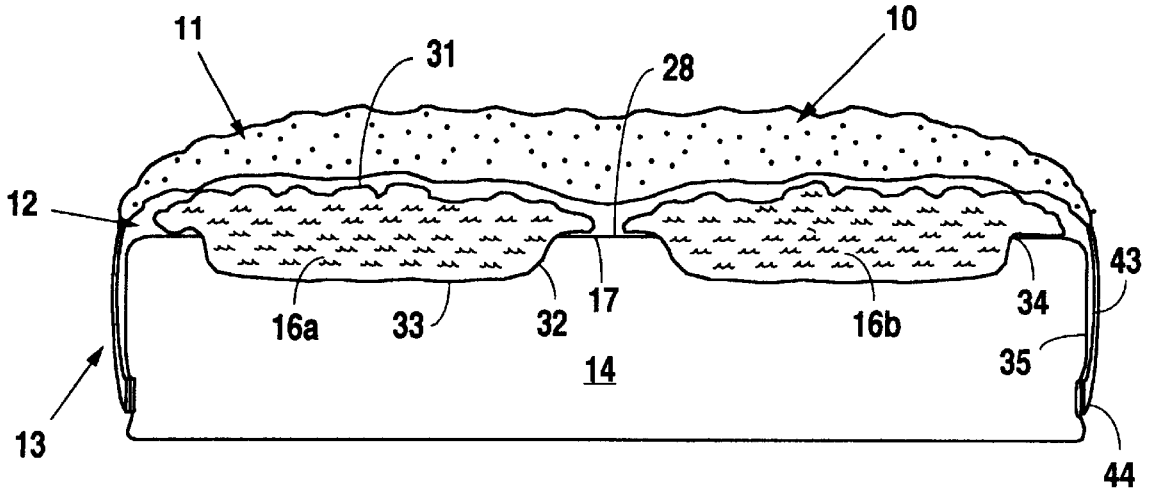
FIG. 8 is a vertical sectional view of the alternate embodiment shown in FIG. 7, and illustrating the operation of the fluid bladder layer and inflatable air cushion to support a patient's bony protuberance.
Figure 8B:
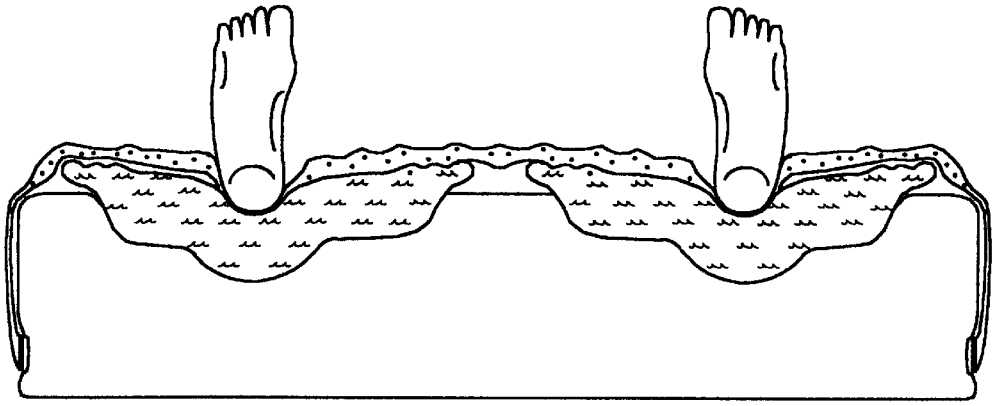
Figure 9:
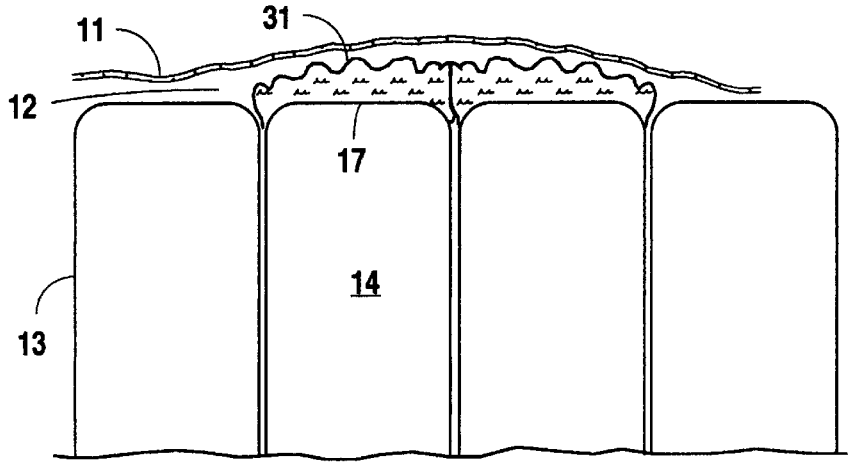
FIG. 9 is a cross-sectional view of the alternate embodiment shown in FIG. 7.

As illustrated in FIGS. 7, 8 and 9, an alternate embodiment of a fluid bladder layer 12 is formed by constructing one or more fluid pouches 16*a–h* integral to the upper surface 17 of multiple joined inflatable air cushions 14*a–b, e–g*, and 1*–m*. In this embodiment, a patient support surface 28 comprises a first surface corresponding to the upper surface 31 of fluid pouches 16*a–h*, and a second surface corresponding to the upper surface 17 of inflatable air cushions 14*a–n*. Each fluid pouch 16*a–h* comprises at least one pouch, and can be formed by a plurality of joined pouches 16 positioned atop an individual air cushion 14. For example, one or more discrete fluid pouches can be joined to form a single fluid pouch layer 16*a* positioned atop an inflatable air cushion 14*a* In a preferred embodiment, fluid pouches 16*a–h* are integrally secured atop air cushions 14*a–b, e–g*, and 1*–n* which correspond to the lower, middle, and upper sections of the patient's body, respectively. It will be understood by those skilled in the art, however, that various configurations and conformations of integrally mounted fluid pouches 16 can be utilized without deviating from the scope of the present invention. The preferred configuration and conformation of integrally mounted fluid pouches 16 is going to be determined by multiple factors such as the desired medical treatment, the height and weight of the patient, and the overall cost effectiveness of a particular design. For example, it is preferable to construct an integrally mounted fluid bladder layer 12 having fluid pouches 16 positioned against the hip, the scapula, the spinal area, heels and occipital region of the head for slim or underweight patients who would exhibit extreme protruding bony areas corresponding to each of these listed regions.

As shown in FIG. 8, an embodiment for a fluid bladder layer 12 is provided by integrally mounting one or more fluid pouches 16*a–b* within a depression or opening 32 formed in the upper surface 17 of an inflatable air cushion 14. The inflatable air cushion 14 is therefore provided with a first surface which forms a patient support surface 28 and a second surface which forms a fluid pouch support surface 33. The fluid pouch 16 is preferably constructed as a discrete and separate pouch member that is specially designed to fit within the dimensions of the depression or opening 32 formed into the air cushion 14. Alternatively, a plurality of fluid pouches 16 can be constructed to fit into one or more depressions or openings 32 formed into the air cushion 14. The fluid pouch or pouches 16 is set into the depression or opening and secured to the air cushion 14 by stitching, welding, or gluing the bottom surface or peripheral edge 34 of the fluid pouch 16 to the fluid pouch support surface 33 and/or patient support surface 28. Referring to FIG. 9, a fluid bladder layer 12 is provided by mounting one or more fluid pouches 16 against the upper surface 17 of an air cushion 14. In this embodiment, a fluid pouch 16 is secured by stitching, welding, gluing, or heat seating the bottom surface or peripheral edge of the fluid pouch 16 to the upper surface 17 of the air cushion 14.

As further illustrated in FIG. 8, it is preferred that the fluid pouch 16 be oversized relative to the depth and area of the depression or opening formed into the air cushion 14 so that the fluid pouch 16 has a top surface 31 which projects out of the depression or opening and is positioned at a higher height relative to the patient support surface 28 of the air cushion 14. The top surface 31 further overlaps and rests against the patient support surface 28 of the air cushion 14.

As a patient moves across a patient support surface he or she is subjected to undesirable lateral shear forces which may exasperate existing skin trauma or lead to the development of bed sores. These lateral shear forces are generally caused by the frictional drag imposed upon a patient's skin as it is moved against a substantially stationary patient support surface. As shown in FIGS. 1–3, 6, and 8–9, the lateral shear forces experienced by a patient resting atop a fluid bladder layer 12 and/or inflatable air mattress 13 are reduced by using an anti-shear top cover layer 11. In a preferred embodiment, illustrated in FIGS. 9 and 10, a top cover layer 11 is divided into top 37 and bottom fabric sheets 38 that are sealingly joined about their respective perimeters (39 and 40) to form a chamber or pouch 41 (see FIG. 3) into which a lubricant is disposed. The lubricant operates to promote and enhance slippage between the contacting surfaces of the adjacently positioned top 37 and bottom sheets 38 so that the patient's skin resting against the top sheet 37 does not experience frictional drag with the top sheet 37, but slides with the top sheet 37 as the top sheet slides across the contacting surface of the bottom sheet 38. It should be understood by those skilled in the art that the bottom sheet 38 is generally held by frictional forces to the upper surface 31 of the fluid bladder layer 12 and/or the upper surface 17 of the inflatable low air loss mattress 13 and is, therefore, held in a relatively fixed position as the top sheet 37 slides across the upper surface of the bottom sheet 38.

As shown in FIG. 9, an anti-shear cover layer 11 comprises a top fabric sheet 37 superimposed over a bottom fabric sheet 38 so that the top layer 37 generally forms a patient support surface 18, and the bottom layer 38 rest against the upper surface 31 of the fluid bladder layer 12 and/or inflatable low air loss mattress 13. The top 37 and bottom sheet 38 are preferably made of a water proof but moisture vapor permeable fabric material. One such suitable fabric material is the fabric commonly sold under the, trademark GORE-TEX, described in more detail above. It should be understood by those skilled in the art that various other fabric materials or combinations thereof can be used to construct an anti-shear cover layer 11 without deviating from the scope of the present invention. The outer perimeter 39 of the top sheet 37 is secured to the outer perimeter 40 of the bottom sheet 38 using a zipper mechanism, welding, heat sealing, stitching, or any combination thereof.

To promote and enhance significant slippage between the contacting surfaces of the top sheet 37 and the substantially adjacent bottom sheet 38, a lubricant is inserted into the chamber 41 bordered by the joined perimeters of the top 37 and bottom 38 sheets. It is preferable to use a dry lubricant such as glass or plastic microbeads, or similar material. The use of a dry lubricant is preferred so as to allow the cover layer 11 to be constructed of a moisture vapor permeable fabric material such as GORE-TEX. If a low air loss or other breathable fabric material is used to construct the cover layer 11, however, the dry lubricant must be of sufficient size so as to neither escape through the fabric nor plug the venting pores that allow moisture vapor to travel through the fabric. The cover layer 11 can also be constructed with the contacting surface of the top 37 and bottom 38 sheets made from a slick material such as teflon or some similar material providing increased slippage between the two sheets. It should be understood that a lubricant can also be placed between the upper surface of the fluid bladder layer 12 and the bottom surface of the cover layer 11 to further minimize lateral shear forces between the patient and the patient support surface.

Figure 10:
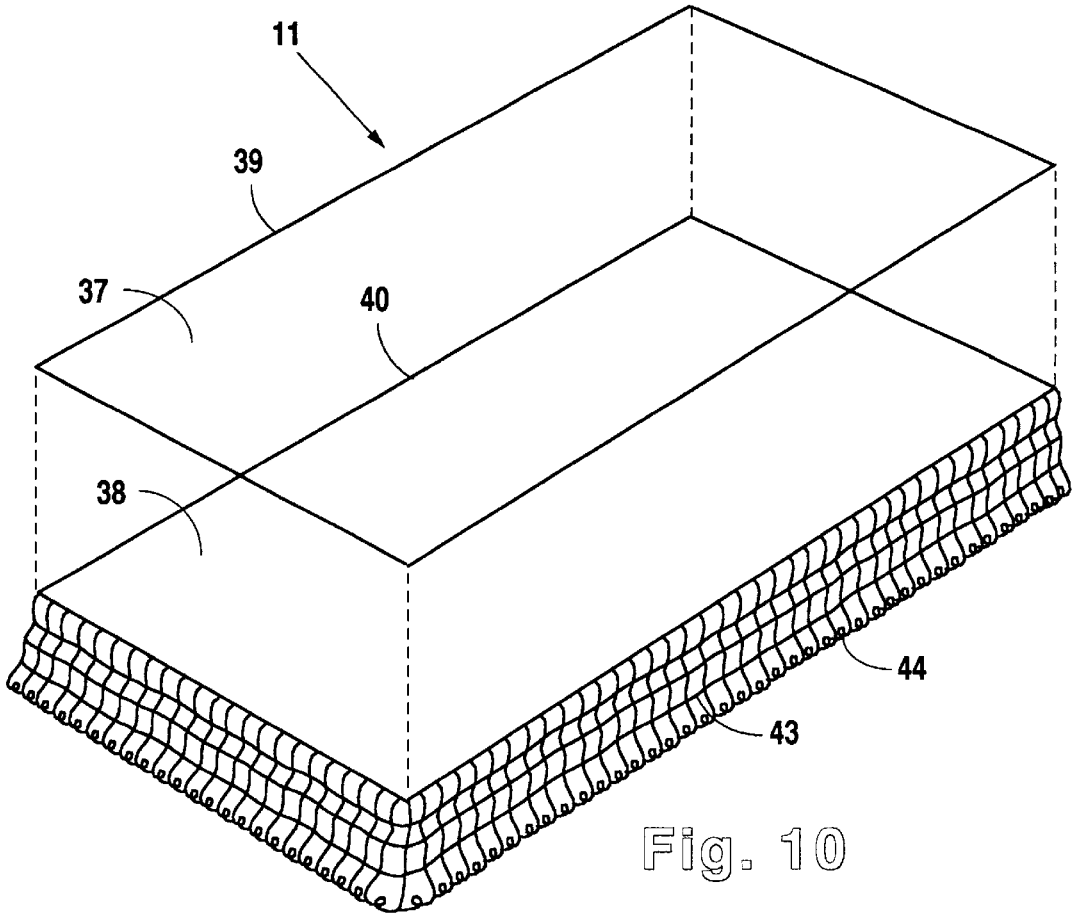
FIG. 10 is an exploded view of an anti-shear top cover layer illustrating the top fabric layer positioned above the bottom fabric layer and the fabric sleeve used to secure the anti-shear cover layer to an underlying inflatable air mattress.
Figure 11:
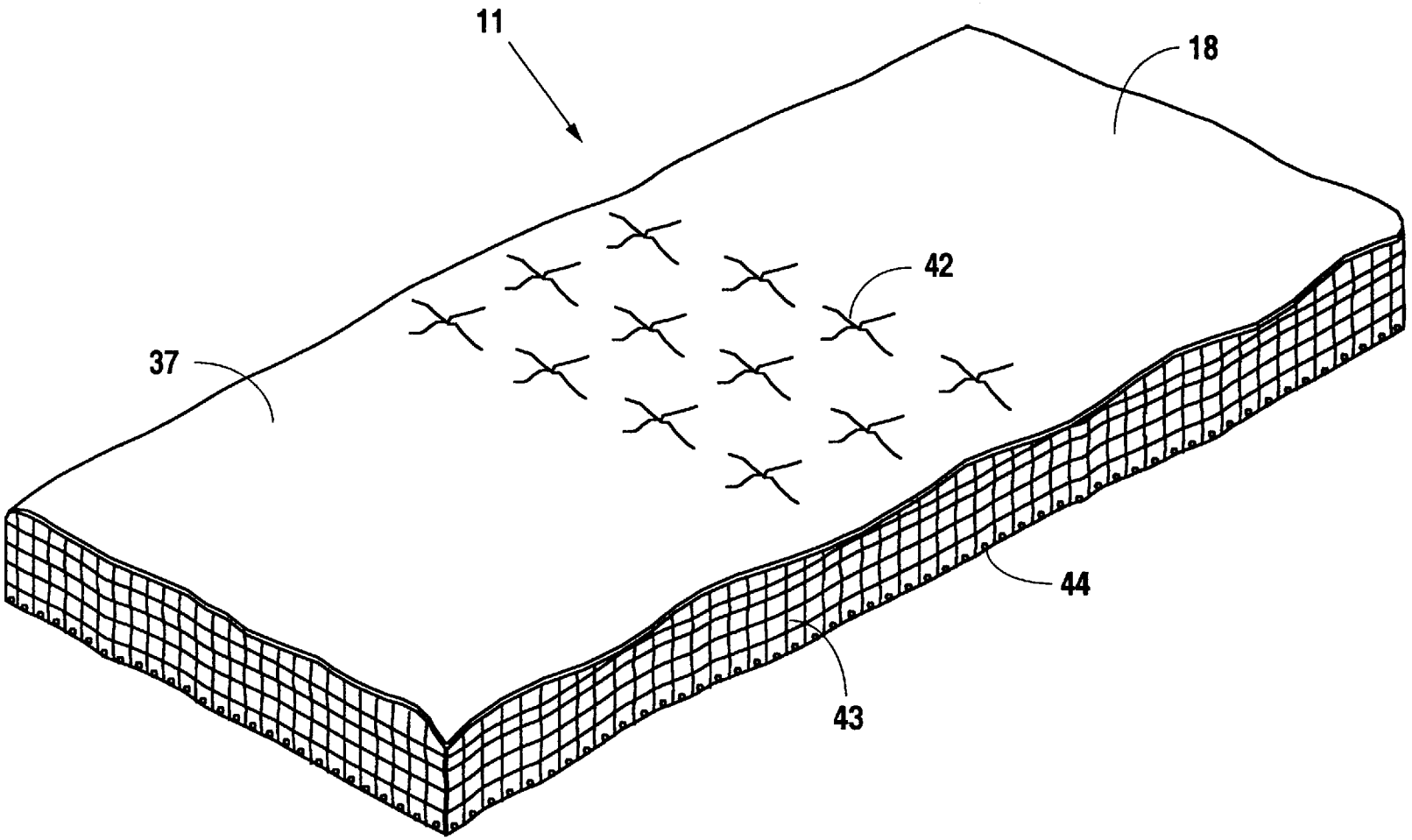
FIG. 11 shows a perspective view of the anti-shear top cover layer.

In a preferred embodiment, as illustrated in FIG. 10, the top 37 and bottom 38 sheets are secured to each other to form additional seams and/or section borders to limit the relative sliding movement between the top and bottom sheets. By way of example, a series of stitched seams 42 are used to connect the top 37 and bottom 38 sheets in such a manner as to prevent slippage between the two sheets along the middle section of the cover layer 11. These seams 42 are therefore useful in preventing a patient from sliding either down or up the patient support surface when either the head section or other sections of the inflatable patient support are elevated. A less restrictive way to resist excess patient slippage is to construct particular sections of the top sheet 37, such as the middle section, with a surface material that is relatively resistant to sliding against the contacting surface of the bottom sheet 38. For example, the contacting surfaces of the top 37 and bottom sheet 38 are made so that the fabric stitching pattern used to construct the sheets are positioned perpendicular to each other along the contacting surface of the top 37 and bottom sheet 38. In this embodiment, the contacting perpendicular surface stitches reduces the sliding movement of the contacting surfaces relative to the contacting surfaces having parallel stitching alignments. It should be understood by those skilled in the art that other means for preventing sliding movement, such as adhesive contacting surfaces, surfaces without lubricant, and various combinations of those described above can be used without deviating from the scope of the present invention.

As shown in FIGS. 9 and 10, a preferred means for securing the cover layer 11 atop the fluid bladder layer 12 and/or inflatable air mattress 13 is provided as an elastic net siding 43 or similar fabric material framing the sealingly joined perimeters of the top 37 and bottom 38 sheets. The net siding 43 is preferably made of an elastic fabric material which allows the net siding 43 to be stretched about the side walls 35 of an underlying inflatable patient support 13, but is operable to draw tight against the side wall 35 to hold the cover layer 11 in place. The net siding 43 is further constructed with a bottom peripheral edge 44 made of a binding mechanism such as a self-tightening elastic band perimeter, drawstring, or similar mechanism. In a preferred use, the cover layer 11 is placed atop the fluid bladder layer 12 and/or inflatable air mattress 13, wherein the net siding is drawn downwardly along and against the side wall 35 of the inflatable air mattress 13, and the elastic net siding 43 and peripheral edge binding mechanism 44 draw tight to hold the cover layer 11 in place (as shown in FIG. 8). With this construction, the bed user can remove the anti-shear cover layer 11 quickly and easily from the bed to clean it or simply remove it as may be desired. Securing a cover layer 11 atop an inflatable air mattress 13 can also include alternative attachment means such as buckles, hook and loop connectors, snaps, a zipper mechanism, or any combination thereof secured directly to the perimeter of the cover layer 11 or to fabric straps coupled to the perimeter of the cover layer 11. In this alternative embodiment, a cover layer 11 is first positioned atop a fluid bladder layer 12, the alternative attachment means are then secured to corresponding attachment means mounted to the bed frame, the sides of the inflatable air mattress 13, or the fluid bladder layer 12.

In a preferred embodiment, as illustrated in FIG. 2, an anti-shear cover layer 11 is oversized relative to the upper surface 17 of an inflatable air mattress 13. As shown in FIG. 2, a preferred anti-shear cover layer 11 has surfaces which bunch up and form overlapping billows and folds. This oversizing enables a patient to sink into the anti-shear cover layer 11 without drawing the surface of the cover layer 11 taut like a hammock. A patient resting against the patient support surface 18 of a preferred cover layer 11 is therefore able to sink into an inflatable air mattress 13, as far as the inflation pressure within the inflatable air mattress 13 will withstand.

Figure 12:
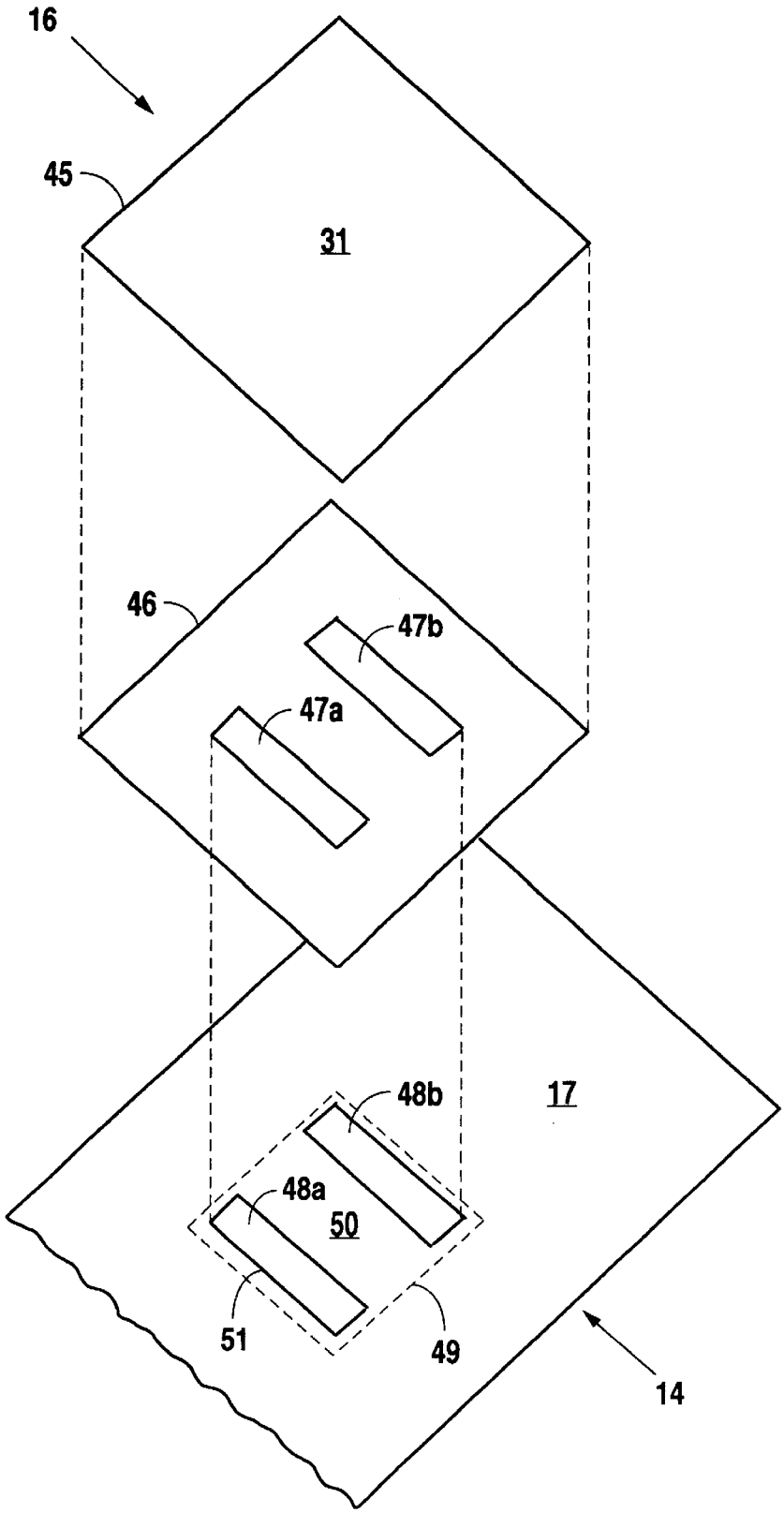
FIG. 12 is an exploded view of the fluid pouch and the VELCRO connector strips illustrated in FIG. 4.

The fluid pouches 16 of the present invention are preferably formed using various means of construction which include welding, sealing, or gluing assembly. The top 45 and bottom 46 layers are preferably made from plastic or some similar material which is deformable, highly resistant to tearing or puncturing, and leak proof. In a preferred embodiment, as shown in FIG. 12, each fluid pouch 16 is constructed from top 45 and bottom 46 layers sealingly joined about their respective perimeters to form a leak-proof pouch for containing a fluid therein. As shown, the upper surface 31 of each fluid pouch 16 is preferably oversized relative to the upper surface 17 of the air cushion 14 or other inflatable patient support to which it is attached. To accomplish this, the upper surface 31 occupies an area substantially larger than the area of the air cushion 14 secured underneath the fluid pouch 16. By way of example, the area occupied by the upper surface 31 of the fluid pouch 16 is specially designed to be two to four times the area of the upper surface 17 of the air cushion 14 to which the fluid pouch 16 is attached. The oversizing is preferably in all directions so that both the length and width of the fluid pouch 16 is one to two times the corresponding length and width of the underlying air bag 16. This embodiment is preferred whether the underlying air cushion 14 is dimensioned as a square, rectangle, or otherwise. When secured to a fabric sheet 15, a fluid pouch 16 is oversized relative to the upper surface 17 of the fabric sheet 15 to which it is attached.

The pressure compensating low air loss bed is designed to be primarily used with a conventional hospital bed frame, but as will be understood by those skilled in the art can be adapted for use with other patient supports such as an examination table, wheelchair, or other patient support frame.

While the description given herein reflects the best mode known to the inventor, those who are reasonably skilled in the art will quickly recognize that many omissions, additions, substitutions, modifications and alternate embodiments may be made of the teachings herein. Recognizing that those of reasonable skill in the art will easily see such alternate embodiments, they have in most cases not been described herein in order to preserve clarity.

What is claimed is:

1. A patient support system especially suitable for use in conjunction with a low air loss inflatable air mattress comprising:

a first layer comprising a top sheet, forming a surface for supporting a patient thereon, having an outer perimeter secured to the outer perimeter of a bottom sheet to form a chamber between said top and bottom sheets, wherein a lubricant is deposited within said chamber to facilitate slidable movement of said top sheet relative to said bottom sheet, and facilitate the slidable movement of a patient supported on said top sheet; and a second layer, comprising a fluid pouch secured to a fabric sheet, said fabric sheet having an upper surface substantially adjacent to the bottom surface of said bottom sheet of said first layer, said fabric sheet having a bottom surface secured substantially adjacent to the upper surface of an inflatable patient support; and, a third layer, comprising an inflatable patient support having a longitudinal axis, said inflatable patient support having an upper surface substantially adjacent to the bottom surface of said fabric sheet of said second layer.

2. The patient support system as set forth in claim 1, wherein:

said top sheet of said first layer has an outer perimeter bordering an area of about two to about four times the area bordered by the outer perimeter of said bottom sheet, wherein securing the outer perimeter of said top sheet to the outer perimeter of said bottom sheet forms a patient support surface having an area bordered by said secured outer perimeters of said top and bottom sheets that is substantially oversized relative to the area of said bottom sheet bordered by said secured outer perimeters;

wherein, portions of said oversized patient support surface fold back on each other, and sliding movement of said patient support surface relative to the contacting surface of said bottom sheet is substantial.

3. The patient support system as set forth in claim 1, wherein:

at least a portion of said top and bottom sheet of said first layer is formed of a water vapor permeable but waterproof material.

4. The patient support system as set forth in claim 1, wherein:

at least a portion of said top and bottom sheets of said first layer is formed of a water vapor permeable but lubricant impermeable material.

5. The patient support system as set forth in claim 1, wherein:

said lubricant is a substantially dry lubricant.

6. The patient support system as set forth in claim 5, wherein:

said dry lubricant includes glass microbeads, plastic microbeads, phenolic microbeads, ceramic microbeads or silica microbeads.

7. The patient support system as set forth in claim 1, wherein:

said top sheet of said first layer has a bottom surface made of a material substantially slicker than the top surface of said bottom sheet, wherein said slicker material substantially increases the slidable movement of said top sheet relative to said bottom sheet when said bottom and top surfaces slidably contact each other.

8. The patient support system as set forth in claim 1, wherein:

said first layer includes means for decreasing the sliding movement of a portion of said top sheet relative to a portion of said bottom sheet, wherein the sliding movement of a portion of a patient's body supported on said top sheet is decreased.

9. The patient support system as set forth in claim 8, wherein:

said means for decreasing slidable movement of said top sheet relative to said bottom sheet includes attaching a portion of said top and bottom sheets to each other at at least one point within the area bordered by the secured outer perimeters of said top and bottom sheets, wherein the slidable movement of said top sheet relative to said bottom sheet is substantially decreased at said at least one point of attachment.

10. The patient support system as set forth in claim 1, further including:

means for securing said first layer substantially adjacent to the upper surface of said second layer.

11. The patient support system as set forth in claim 10, wherein:

said means for securing said first layer substantially adjacent to said second layer includes a fabric sleeve framing the outer perimeter of said top and bottom sheets of said first layer, said fabric sleeve having a first edge secured to the outer perimeter of said first layer, and a second edge that extends downwardly in overlying relation to the surface of said third layer, and said second edge having a means for attaching said second edge of said fabric sleeve to said third layer;

wherein, said first layer is placed in overlying relation to said second layer, said fabric sleeve fits in overlying relation to the surface of said third layer, said attaching means secures said second edge of said fabric sleeve to said third layer, wherein said first layer fits substantially adjacent to the surface of said second layer.

12. The patient support system as set forth in claim 11, wherein:

said means for attaching said fabric sleeve of said first layer to said surface of said third layer is made of a substantially elastic material.

13. The patient support system as set forth in claim 11, wherein:

said means for attaching said fabric sleeve of said first layer to said surface of said third layer comprises a buckling device, mating snaps, and adhesive material.

14. The patient support system as set forth in claim 1 wherein:

said at least one fluid pouch is substantially adjacent to an inflatable patient support.

15. The patient support system as set forth in claim 14 wherein:

said at least one fluid pouch further includes means for attaching said at least one fluid pouch substantially adjacent to said inflatable patient support.

16. The patient support system as set forth in claim 15 wherein:

said means for attaching said fluid pouch substantially adjacent to said inflatable patient support comprises hook and loop material secured to said fluid pouch for connecting to corresponding hook and loop material secured to said inflatable patient support;

wherein, said at least one fluid pouch is set substantially adjacent to said inflatable patient support, and said hook and loop material secured to said fluid pouch engages with said hook and loop material secured to said inflatable patient support, wherein said fluid pouch is attached to said inflatable patient support.

17. The patient support system as set forth in claim 1 wherein:

the fluid contained within said fluid pouches has a viscosity greater than the viscosity of water.

18. The patient support system as set forth in claim 1 wherein:

at least a portion of said fabric sheet of said second layer is formed of a water vapor permeable but waterproof material.

19. The patient support system as set forth in claim 1 wherein:

said fluid pouch further includes means for releasably attaching said fluid pouch to said fabric sheet.

20. The patient support system as set forth in claim 19 wherein:

said means for releasably attaching said fluid pouch to said fabric sheet comprises a hook and loop connecting material secured to said fluid pouch for connecting to mating hook and loop connecting material secured to said fabric sheet.

21. The patient support system as set forth in claim 1 wherein:

said inflatable patient support is an inflatable air mattress.

22. The patient support system as set forth in claim 21 wherein:

said inflatable air mattress comprises at least one inflatable air chamber joined to form a patient support surface, wherein at least a portion of said patient support surface is substantially adjacent to the bottom surface of said second layer.

23. The patient support system as set forth in claim 21 wherein:

said at least one inflatable air chamber is a plurality of inflatable air chambers, said plurality of inflatable air chambers joined transversely relative to a longitudinal axis of said patient support surface.

24. The patient support system as set forth in claim 1 wherein:

at least a portion of said inflatable patient support is formed of a water vapor permeable but waterproof material.

25. A patient support system comprising:

a first layer, comprising a top sheet, forming a surface for supporting a patient thereon, having an outer perimeter secured to the outer perimeter of a bottom sheet to form a chamber between said top and bottom sheets, wherein a lubricant is deposited within said chamber to facilitate slidable movement of said top sheet relative to said bottom sheet, and facilitate the slidable movement of a patient supported on said top sheet;

a second layer, said second layer comprising a fluid pouch, said fluid pouch having means to releasably secure said fluid pouch proximate an inflatable patient support; and, a third layer, said third layer comprising an inflatable patient support, and having a surface substantially adjacent to the surface of said at least one fluid pouch forming said second layer.

26. The patient support system as set forth in claim 25 wherein:

said means for securing said fluid pouch to said inflatable patient support is an adhesive fabric material secured to said fluid pouch, said adhesive fabric material attaches to corresponding adhesive fabric material secured to the surface of said inflatable patient support;

wherein, said fluid pouch is releasably secured substantially adjacent to the surface of an inflatable patient support.

27. A patient support system comprising:

a first layer, said first layer comprising a top sheet, forming a surface for supporting a patient thereon, having an outer perimeter secured to the outer perimeter of a bottom sheet to form a chamber between said top and bottom sheets, wherein a lubricant is disposed within said chamber to facilitate slidable movement of said top sheet relative to said bottom sheet, and facilitate the slidable movement of a patient supported on said top sheet;

a second layer, said second layer comprising a fluid pouch integrally connected to the surface of an inflatable patient support; and, a third layer, said third layer comprising an inflatable patient support, said inflatable patient support having a surface substantially adjacent to the integrally connected surface of said at least one fluid pouch, said at least one fluid pouch forming said second layer.

28. A patient support system comprising:

a first layer, said first layer comprising a bottom and top sheet for supporting a patient thereon, said top sheet in slidable intimate contact with said underlying bottom sheet;

a second layer, said second layer comprising at least one fluid pouch with a first surface substantially adjacent to said first layer, and a second surface substantially adjacent to a third layer; and said third layer comprising an inflatable patient support.

* * * * *